US011687111B2

(12) United States Patent
Lai et al.

(10) Patent No.: US 11,687,111 B2
(45) Date of Patent: Jun. 27, 2023

(54) REFERENCE GENERATOR USING FET DEVICES WITH DIFFERENT GATE WORK FUNCTIONS

(71) Applicant: Analog Devices International Unlimited Company, Limerick (IE)

(72) Inventors: Chiong Yew Lai, Singapore (SG); Lei Liu, Singapore (SG)

(73) Assignee: Analog Devices International Unlimited Company, Limerick (IE)

( * ) Notice: Subject to any disclaimer, the term of this patent is extended or adjusted under 35 U.S.C. 154(b) by 237 days.

(21) Appl. No.: 16/996,252

(22) Filed: Aug. 18, 2020

(65) Prior Publication Data

US 2021/0132649 A1 May 6, 2021

Related U.S. Application Data

(63) Continuation of application No. 16/671,782, filed on Nov. 1, 2019, now Pat. No. 10,782,723.

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS 5,159,260 A 10/1992 Yoh et al.
6,215,352 B1 4/2001 Sudo
6,225,855 B1 5/2001 Taguchi
6,437,550 B2 8/2002 Andoh et al.
6,552,603 B2 4/2003 Ueda
6,590,445 B2 7/2003 Ueda
6,653,694 B1 11/2003 Osanai
6,876,251 B2 4/2005 Watanabe
7,426,146 B2 9/2008 Aota et al.
8,692,610 B2 4/2014 Takahashi
9,213,415 B2 12/2015 Yoshino et al.
(Continued)

FOREIGN PATENT DOCUMENTS

CN 112787640 A 5/2021
JP 2010176258 A 8/2010
(Continued)

OTHER PUBLICATIONS

U.S. Appl. No. 16/671,782, filed Nov. 1, 2019, Reference Generator Using 2019 FET Devices With Different Gate Work Functions.
"U.S. Appl. No. 16/671,782, Ex Parte Quayle Action dated Apr. 6, 2020", 4 pgs.
"U.S. Appl. No. 16/671,782, Notice of Allowance dated May 18, 2020", 5 pgs.
(Continued)

*Primary Examiner* — Jeffery S Zweizig
(74) *Attorney, Agent, or Firm* — Schwegman Lundberg & Woessner, P.A.

(57) ABSTRACT

A reference signal generator circuit can be configured to provide a temperature-compensated voltage reference signal at an output node. The reference signal generator can include a diode-connected first FET device coupled between a supply node and the output node, and a flipped-gate transistor coupled between the output node and a reference node. The reference signal generator can include a bias current source configured to provide a bias current to the output node to adjust a current density in the flipped-gate transistor relative to a current density in the first transistor.

19 Claims, 8 Drawing Sheets

(56) References Cited

U.S. PATENT DOCUMENTS

| | | | |
|---|---|---|---|
| 9,552,009 | B2 | 1/2017 | Hashitani et al. |
| 9,590,504 | B2 | 3/2017 | Al-shyoukh et al. |
| 9,666,574 | B1 | 5/2017 | Lee et al. |
| 10,181,854 | B1 | 1/2019 | Kobayashi |
| 10,241,535 | B2 | 3/2019 | Al-shyoukh et al. |
| 10,782,723 | B1 | 9/2020 | Lai et al. |
| 2017/0212538 | A1 | 7/2017 | Al-shyoukh et al. |
| 2019/0044478 | A1 | 2/2019 | Kobayashi et al. |
| 2019/0064867 | A1 | 2/2019 | Al-shyoukh et al. |
| 2019/0109589 | A1 | 4/2019 | Kobayashi et al. |

FOREIGN PATENT DOCUMENTS

| | | | |
|---|---|---|---|
| JP | 2014149692 | A | 8/2014 |
| TW | 201612671 | A | 4/2016 |
| TW | I528130 | B | 4/2016 |
| TW | I602280 | B | 10/2017 |
| TW | I759924 | B | 4/2022 |

OTHER PUBLICATIONS

"U.S. Appl. No. 16/671,782, Response filed May 11, 2020 to Ex Parte Quayle Action dated Apr. 6, 2020", 7 pgs.

Al-Shyoukh, Mohammad, et al., "A 500nA Quiescent Current, Trim-Free, Plus or Minus 1.75 Percent Absolute Accuracy, CMOS-Only Voltage Reference based on Anti-Doped N-Channel MOSFETs", Proceedings of the IEEE 2014 Custom integrated Circuits Conference, (2014), 4 pgs.

Oguey, Henry J, et al., "MOS Voltage Reference Based on Polysilicon Gate Work Function Difference", IEEE Journal of Solid-State Circuits, SC-15(3), (Jun. 1980), 264-269.

Watanabe, Hirobumi, et al., "CMOS Voltage Reference Based on Gate Work Function Differences in Poly-Si Controlled by Conductivity Type and Impurity Concentration", IEEE Journal of Solid-State Circuites, 38(6), (Jun. 2003), 987-994.

"Taiwanese Application Serial No. 109137221, Office Action dated Jun. 16, 2021", w/ English Translation, 19 pgs.

Navidi, Mir Mohammad, et al., "A Low-Power Voltage Reference Cell with a 1.5 V Output", J. Low Power Electron. Appl., 8(19), 12 pgs.

REFERENCE GENERATOR USING FET DEVICES WITH DIFFERENT GATE WORK FUNCTIONS

CLAIM OF PRIORITY

This application is a continuation of U.S. application Ser. No. 16/671,782, filed Nov. 1, 2019, which is hereby incorporated by reference herein in its entirety.

BACKGROUND

A reference circuit can be used to provide a reference current signal or reference voltage signal for use in various circuits. In an example, a reference signal can be used to provide a stable and accurate bias signal for use by various components or systems such as amplifiers, comparators, analog-to-digital converters, digital-to-analog converters, oscillators or phase locked loops, among others.

Several different types of reference signal generator circuits can be provided. Some examples of the different types can include a bandgap reference signal generator, a MOS-Vth difference-type reference signal generator, and a work function difference-type reference signal generator.

A bandgap-type reference signal generator can be provided using bipolar junction transistor (BJT) devices. The bandgap-type generator can include voltage sources with respective positive and negative temperature coefficients such that, when the sources are summed, the temperature-dependence of the devices can be canceled. A bandgap-type reference signal generator can have some limitations, however, such as susceptibility to substrate noise.

A work function difference-type reference signal generator can generally consume less power than the other types of reference signal generators, and can exhibit minimal dependence on process variation. The work function difference-type reference signal generator, however, can exhibit temperature dependence that can compromise its accuracy over different use conditions.

BRIEF SUMMARY

The present inventors have recognized, among other things, that a problem to be solved includes providing a reference voltage or reference current signal that is substantially stable, temperature-independent, and useful over expected process-related manufacturing variations. In an example, a solution to the problem can include or use a work function difference-type reference signal generator. The signal generator can include at least one standard metal oxide semiconductor (MOS) device and at least one work function-modified or flipped-gate nMOS device. The solution can include differently biasing the standard and flipped-gate devices such that the devices have respective different current densities. When the devices are biased accordingly, an output signal can be provided that is a function of the difference in threshold voltages and gate-source overdrive voltages of the two devices. The output signal can be used as a voltage reference and can be substantially stable over temperature and process-related variations.

In an example, the solution can include a reference signal generator circuit configured to provide a temperature-compensated voltage reference signal at an output node. The reference signal generator circuit can include a first transistor coupled between a supply node and the output node, a flipped-gate transistor coupled between the output node and a reference node, and a bias current source configured to provide a bias current to the flipped-gate transistor at the output node to adjust a current density in the flipped-gate transistor relative to a current density in the first transistor. In an example, a ratio of an effective gate width of the first transistor to an effective gate width of the flipped-gate transistor can be at least 10:1.

In an example, the solution can include a method for providing a temperature-compensated voltage reference signal at an output node of a reference signal generator circuit. The method can include receiving a first current bias signal at a drain terminal of a diode-connected first transistor, wherein the first transistor is coupled between a supply node and the output node. The method can include receiving at least a portion of the first current bias signal at a drain terminal of a flipped-gate transistor that is coupled between the output node and a reference node. The method can further include providing a second bias signal to the flipped-gate transistor at the output node to provide a higher current density in the flipped-gate transistor relative to a current density in the first transistor. The method can further include providing the voltage reference signal from the output node when the transistors are biased with the first and second bias signals.

This Summary is intended to provide an overview of the present subject matter. It is not intended to provide an exclusive or exhaustive explanation of the invention. The detailed description is included to provide further information about the present subject matter.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The following description includes examples of systems, methods, apparatuses, and devices for providing a voltage reference circuit using MOS transistor devices with different gate work functions. Throughout the description, reference is made to the accompanying drawings, which form a part of the detailed description. The drawings show, by way of illustration, embodiments in which the inventions disclosed herein can be practiced. These embodiments are generally referred to herein as "examples." Such examples can include elements in addition to those shown or described. However, the present inventors also contemplate examples in which only those elements shown or described are provided. The present inventors contemplate examples using any combination or permutation of those elements shown or described (or one or more aspects thereof), either with respect to a particular example (or one or more aspects thereof), or with respect to other examples (or one or more aspects thereof) shown or described herein.

A voltage or current reference circuit is a common building block and is used ubiquitously in integrated circuits. In an example, voltage reference generation can be handled by bipolar transistors arranged to form a voltage reference based on the silicon bandgap voltage. Bipolar transistors, however, can be physically large and susceptible to noise. Furthermore, in simple CMOS processes, only a PNP-type substrate may be available, thus limiting circuit topologies that can be used. Some MOSFET-based voltage reference topologies provide relatively low power solutions that occupy less area than some bipolar voltage references. In some cases, however, an operating temperature range of MOSFET-based references can be limited (e.g., to 80° C.). In other examples, additional processing can be required to fabricate special MOSFET devices with a typical device characteristics.

Figure 1:
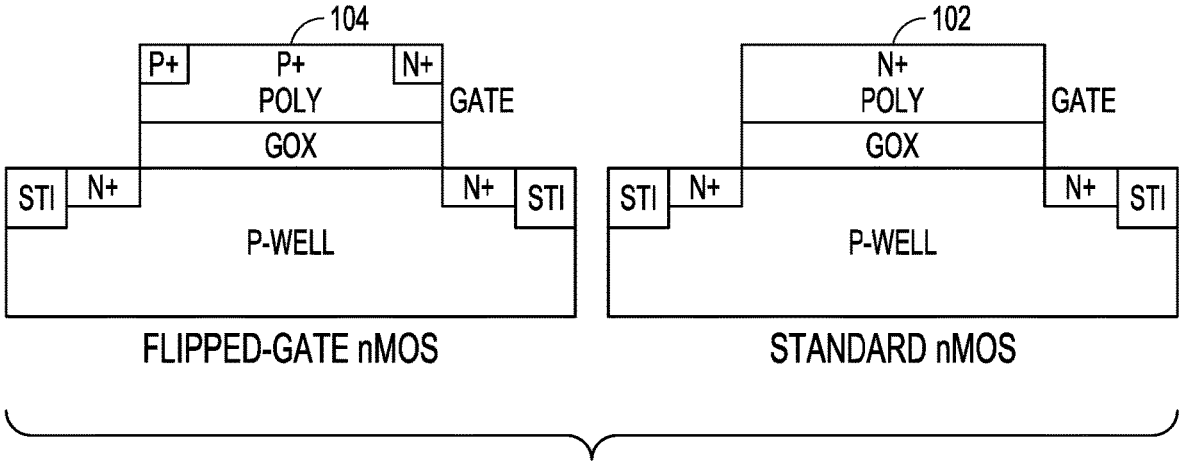
FIG. 1 (PRIOR ART)
FIG. 1 illustrates generally examples of standard and flipped-gate nMOS devices.

FIG. 1 illustrates generally examples of different nMOS devices. In FIG. 1, a standard nMOS device 102 can include a P-type well and an N+ type gate. The example of FIG. 1 includes a flipped-gate nMOS device 104 that can include a P-type well, and a P+ type gate that is selectively doped with N+ material. That is, the flipped-gate nMOS device 104 can include a special nMOS device having a gate work function that is modified by selectively doping the gate. A flipped-gate nMOS device, or "anti-doped" device, can have a threshold voltage that is greater than a standard nMOS device. Standard and flipped-gate devices can exhibit negative temperature slope characteristics, such as with different gradients. Accordingly, a difference between threshold voltages of standard and flipped-gate devices can have a negative temperature slope. In an example, current densities of standard and flipped-gate devices can be adjusted to compensate for the negative temperature slope. A voltage reference that is substantially constant over temperature can thus be provided using a standard device and a flipped-gate device together.

The term "work function" or workfunction can be used to describe a voltage that is required to extract an electron from a material in a vacuum. For many metals, the voltage can be between three and five volts. In an example, a reference generator can include FET devices that have respective different work functions and hence have different threshold characteristics. When the FET devices are used together, the circuit can provide a reference generator circuit that consumes a minimal amount of power, operates over a wide supply range, and is trimmable or adjustable to achieve high accuracy over process variation, operating voltage variation, and temperature variation. In an example, the reference generators described herein can have a reduced size or footprint relative to conventional bandgap or other reference generator topologies.

Physically, doping of a polysilicon gate of a work function-modified device can be adjusted relative to a gate of a standard device, such as while other device characteristics remain the same. The resulting devices can thus have substantially similar or correlated operating characteristics. The difference in the threshold voltages of the devices can exhibit a negative temperature coefficient and, at 0K, can approach the silicon bandgap voltage.

In an example, bias conditions or a current density of a work function-modified device and of a standard device can be adjusted such that differences in the respective gate overdrive voltages ($V_{OV_device}$) have a positive temperature coefficient. For example, if the respective device temperature coefficients of first and second devices are of equal magnitude but opposite sign, then a difference in the gate-source voltages ($V_{GS_device}$) of work function-modified and standard nMOS devices can be substantially constant over temperature, as demonstrated by the following:

$$V_{GS1}=V_{TH1}+V_{OV1}$$

$$V_{GS2}=V_{TH2}+V_{OV2}$$

$$V_{GS1}-V_{GS2}=(V_{TH1}-V_{TH2})+(V_{OV1}-V_{OV2})$$

$$\partial(V_{GS1}-V_{GS2})/\partial T=\partial(V_{TH1}-V_{TH2})/\partial T+\partial(V_{OV1}-V_{OV2})/\partial T$$

where $\partial(V_{TH1}-V_{TH2})/\partial T$ has a negative temperature coefficient and $\partial(V_{OV1}-V_{OV2})/\partial T$ has a positive temperature coefficient.

Figure 2:
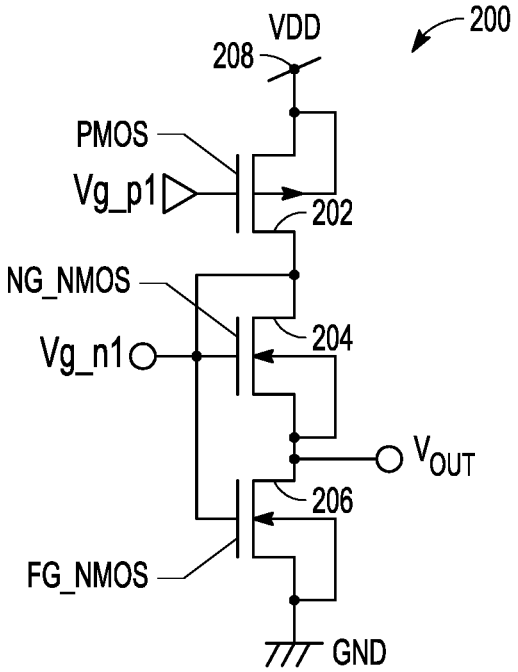
FIG. 2 (PRIOR ART)
FIG. 2 illustrates generally a first voltage reference circuit that includes devices having respective different work function characteristics.

FIG. 2 illustrates generally a first voltage reference circuit 200 that includes devices having respective different work function characteristics. The first voltage reference circuit 200 includes a first FET device PMOS 202 coupled to a power supply node 208 that provides a supply voltage Vdd. The first FET device PMOS 202 can include a p-channel metal oxide semiconductor transistor having a source terminal coupled to the power supply. The first voltage reference circuit 200 includes a second FET device NG_NMOS 204 that is coupled in series with the first FET device PMOS 202, and a third FET device FG_NMOS 206 that is coupled in series with the second FET device NG_NMOS 204. In this configuration, the three FET devices 202, 204, and 206 are coupled in series and each device can carry substantially the same constant current, Ids, between its respective source and drain terminals.

In the first voltage reference circuit 200, the second FET device NG_NMOS 204 includes a conventional n-channel metal oxide semiconductor (nMOS) transistor having an $n^+$-type gate electrode, such as can be doped with phosphorus (P), and can have a threshold voltage of about 0.9 V. The third FET device FG_NMOS 206 can include a $p^+$-type gate electrode, such as can be doped with boron (B). The $p^+$-type gate electrode can have a different work function than the $n^+$-type gate electrode, for example, by about 1.0 V, and thus the third FET device FG_NMOS 206 can have a threshold voltage of about 1.9 V. In the first voltage reference circuit 200, the second FET device NG_NMOS 204 and third FET device FG_NMOS 206 can have substantially the same gate width W and gate length characteristics, however, devices of other sizes can similarly be used.

In the first voltage reference circuit 200, the first FET device PMOS 202 can provide a constant current to the series-coupled second FET device NG_NMOS 204 and third FET device FG_NMOS 206. The first FET device PMOS 202 can receive a gate voltage Vg_p1 at its gate terminal. In other examples, a resistor can be provided in place of the first FET device PMOS 202.

Gate terminals of the second FET device NG_NMOS 204 and third FET device FG_NMOS 206 can be coupled to the drain of the first FET device PMOS 202. The potential of the gates can have a voltage Vg_n1. In an example, the second FET device NG_NMOS 204 can be provided in a shallow p-type well of a deeper n-type well. In this example, since the p-type well is coupled to the source of the second FET device NG_NMOS 204, a voltage potential of the p-type well is not fixed to ground (GND), and can be used to provide a reference voltage. That is, when the first FET device PMOS 202, second FET device NG_NMOS 204, and third FET device FG_NMOS 206 are coupled in series, as shown in FIG. 2, and operated to conduct a current Ids therethrough, the work function difference between the $p^+$-type gate electrode and the $n^+$-type gate electrode is equal to the source voltage of the second FET device NG_NMOS 204. The source voltage can provide an output signal Vout that can be used a reference voltage signal.

Figure 3:
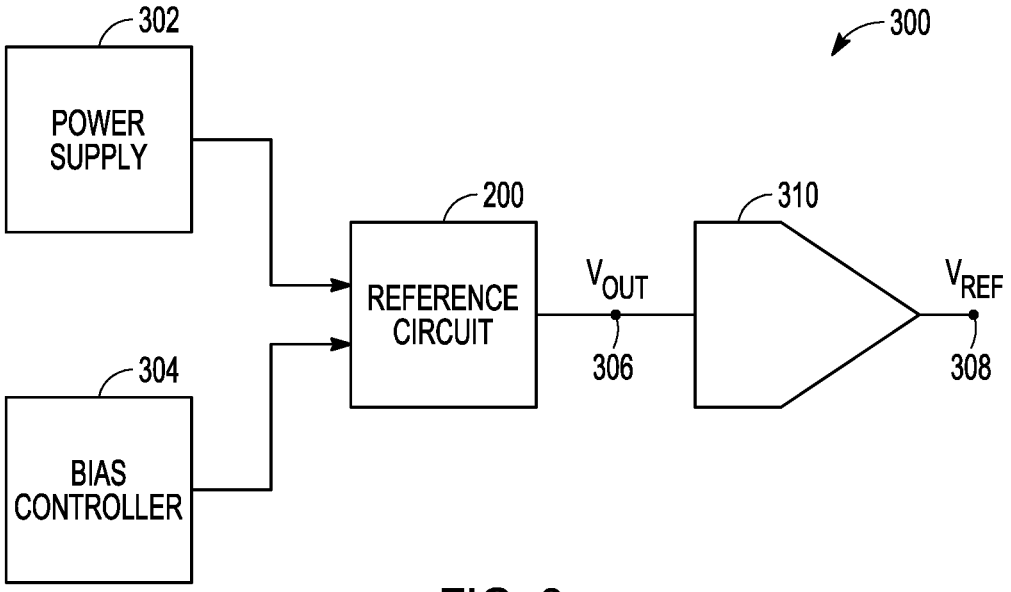
FIG. 3 illustrates generally a block diagram of a first reference signal generator.

FIG. 3 illustrates generally a block diagram of a first reference signal generator 300. The first reference signal generator 300 can include a power supply 302, a bias controller 304, an amplifier circuit 310, and, in an example, the first voltage reference circuit 200 from the example of FIG. 2. The first voltage reference circuit 200 can provide an intermediate output signal Vout at an intermediate output node 306 to the amplifier circuit 310. In response, the amplifier circuit 310 can provide a buffered reference voltage output signal Vref at a reference output node 308.

In an example, the first voltage reference circuit 200 is configured to receive a power signal from the power supply 302. For example, the power supply 302 can provide the supply voltage Vdd from the example of FIG. 2, such as with enough current to operate the devices in the first voltage reference circuit 200.

In an example, the bias controller 304 includes an adjustable current source that is configured to provide a bias current signal to one or more devices in the first voltage reference circuit 200. The bias controller 304 can be configured to provide a current signal with a fixed or pre-set magnitude such as can be set at a point of manufacture. In an example, the bias controller 304 can be configured to provide a current signal with an adjustable signal magnitude, such as can be defined by a user. In an example, the bias current signal provided to the first voltage reference circuit 200 can be configured to compensate for process variation in the devices comprising the first voltage reference circuit 200, as further explained below.

Figure 4:
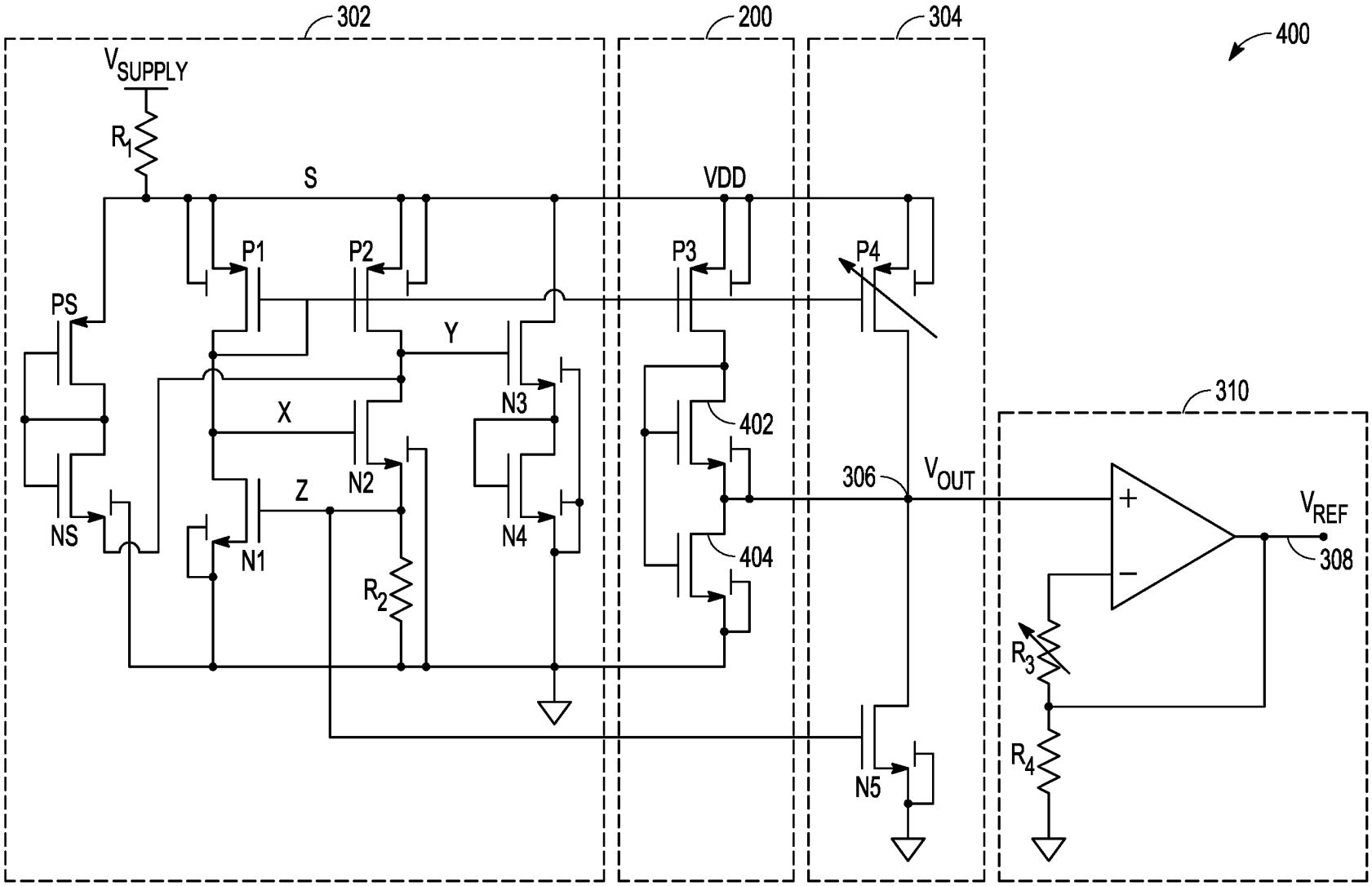
FIG. 4 illustrates generally a schematic example corresponding to the first reference signal generator of FIG. 3.

FIG. 4 illustrates generally a schematic example 400 corresponding to the first reference signal generator 300 of FIG. 3. That is, the schematic example 400 shows an example of how various devices can be arranged and configured to implement the first reference signal generator 300. FIG. 4 illustrates generally an example of flipped-gate and standard devices in the context of a circuit that is configured to manage start-up and bias current generation to operate and provide a reference signal over a varied supply range.

In the schematic example 400, the power supply 302 can include or can be coupled to a supply rail Vsupply. Signals from the supply rail can be coupled to a start-up network using a first power resistor R1. In an example, the supply rail can provide variously valued signals, such as having a voltage magnitude of at least about 3.5V. During initial startup, a common source node (S) rises with the supply signal Vsupply via R1 to Vdd. As node S rises, node X can be pulled high by P1 and node Y can be pulled high by series-connected startup FET devices PS and NS. When a voltage at node X rises sufficiently high to turn on N2, then node Z begins to pull high. As a voltage at node Z rises, PMOS devices P1, P2, P3, and P4 can begin conducting current.

In an example, the series-connected devices N3 and N4 regulate node S to a voltage Vdd that can be a function of the gate-source voltages of devices N1, N2, and P1 (e.g., $Vdd=V_{GS,N1}+V_{GS,N2}+V_{GS,P1}$). The devices N3 and N4 can thus regulate node S by shunting any extra current from R1 to ground, thereby allowing a high voltage supply. The devices PS and NS can be disabled after current is established in the circuit, for example without explicit feedback from elsewhere in the circuit. In steady state operation, for example, if FET devices P1 and P2 are similarly sized, then the devices will carry a current equal to $V_{GS,N1}/R2$.

In an example, a small capacitor can be provided between node Y and a reference node or ground, such as to enhance stability of the circuit. In an example, a parasitic capacitance of one or more of the FET devices in the schematic example 400 can be used in place of the capacitor.

In the schematic example 400, the first voltage reference circuit 200 can include a FET device P3, a first standard device 402, and a first modified device 404. The FET device P3 can correspond to the PMOS device in the example of FIG. 2, the first standard device 402 can correspond to the second FET device NG_NMOS 204 in the example of FIG. 2 or to the standard nMOS device 102 in the example of FIG. 1, and the first modified device 404 can correspond to the third FET device FG_NMOS 206 in the example of FIG. 2 or to the flipped-gate nMOS device 104 in the example of FIG. 1. The FET device P3 can be configured to receive a power signal at node S and, in response, provide a current signal to the series-coupled first standard device 402 and first modified device 404. In an example, the first standard device 402 can include a standard Vt (~0.9V) device, and the first modified device 404 can include a special Vt (~1.9V) device.

In the example of FIG. 4, the first standard device 402 and first modified device 404 are connected in series with their gates connected to the drain of the first standard device 402. The source of the first standard device 402 (e.g., coupled to the drain of the first modified device 404) can be configured to provide an output signal Vout at an intermediate output node 306. In the example of FIG. 4, $V_{OUT}$ is a function of the gate-source voltages of the first standard device 402 and the first modified device 404, that is, $V_{OUT}=V_{GS,404}-V_{GS,402}$. The example of FIG. 4 thus illustrates how flipped-gate and standard devices can be arranged such that their gate-source voltages are subtracted and used to provide a signal that can be useful as a voltage reference. In other words, a difference between the gate-source voltages of the first standard device 402 and first modified device 404 can be measured and used as a reference signal.

In an example, the first standard device 402 and the first modified device 404 can have different aspect ratios, can be differently sized devices, or can include different combinations of parallel-coupled devices. In an example, an aspect ratio of the first standard device 402 to the first modified device 404 can be at least 10:1, or can be 20:1 or more. Thus, when biased by current signals from the PMOS devices P3 or P4, an effective current density in each of the first standard device 402 and the first modified device 404 can be substantially different. That is, the first modified device 404 can be operated to have a substantially higher current density than is present in the first standard device 402.

In the example of FIG. 4, the bias controller 304 can include one or more devices configured to provide an adjustable current signal. The bias controller 304 can include a first device coupled between a supply, such as the node S of the power supply 302, and the intermediate output node 306. In an example, the bias controller 304 includes a PMOS device P4 that can include a fixed or trimmable current source to provide a current source at the intermediate output node 306 and thereby adjust a current density in the first modified device 404. By adjusting the current density in the first modified device 404, a temperature-dependence of the signal Vout at the intermediate output node 306 can be minimized.

In an example, the PMOS device P4 can comprise multiple, parallel-connected devices that can be selectively enabled or disabled. That is, the devices can be selectively included or excluded from circuitry corresponding to the schematic example 400. In an example, a process for determining which or how many of the devices P4 to use can include measuring the signal Vout at a first temperature (e.g., room temperature), then heating a die that includes the devices P4 (and the other circuitry of the reference generator circuit), and then measuring again the signal Vout at the elevated temperature. The number of devices to use as the PMOS device P4 can be determined such that the value of Vout is substantially the same at the elevated temperature and at the first temperature.

In an example, the bias controller 304 can include a second device coupled between a reference node or ground and the intermediate output node 306. The second device can include an NMOS device N5 that can include a fixed or trimmable current source to adjust a current density in the first standard device 402. The NMOS device N5 can be configured to adjust the current density around a mean expected value to accommodate error, such as can be introduced by process variation, to thereby help maintain a stable and temperature-independent output at the intermediate output node 306.

In an example, the signal Vout at the intermediate output node 306 can be a high impedance signal and can vary due to process variation or other effects. To correct for this variation and adjust the impedance such that the reference signal can be used to drive various loads, the schematic example 400 includes the amplifier circuit 310. A gain characteristic of the amplifier circuit 310 can be trimmed or can use a feedback network, such as comprising resistors R3 and R4, to produce a constant voltage output signal. For example, when node S is provided at or around 3.5V, the reference signal Vref at the reference output node 308 of the amplifier circuit 310 can be about 2.05V.

Circuits that include the standard nMOS device 102 and flipped-gate nMOS device 104 can be used to provide various reference signals having different signal magnitude or polarity characteristics. Some examples of such circuits are discussed herein at FIG. 5 through FIG. 10. The examples of FIG. 5 through FIG. 10 can be useful with or without the startup, biasing, and signal conditioning circuitry provided in the example of FIG. 4.

Figure 5:
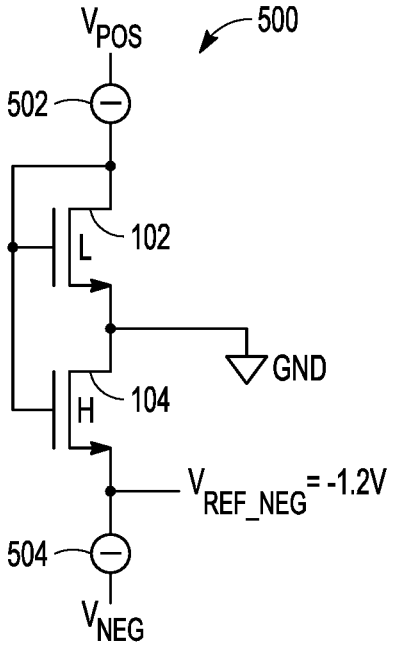
FIG. 5 illustrates generally a first example of a negative reference signal generator circuit.

FIG. 5 illustrates generally a first example of a negative reference signal generator circuit 500. The negative reference signal generator circuit 500 can include or use a series-coupled arrangement of standard and flipped-gate devices, such as the standard nMOS device 102 and the flipped-gate nMOS device 104, to provide a reference output signal Vref_neg that can have a negative polarity.

In an example, the negative reference signal generator circuit 500 can include a first current source 502 coupled to a positive supply rail Vpos, and a second current source 504 coupled to a negative supply rail Vneg. The standard nMOS device 102 and flipped-gate nMOS device 104 can be coupled in series, and can have their respective gate terminals coupled together and coupled to a drain terminal of the standard nMOS device 102. A reference node or ground can be coupled to the source node of the standard nMOS device 102 and to the drain node of the flipped-gate nMOS device 104. The output signal, Vref_neg, can be provided at the source node of the flipped-gate nMOS device 104. In the example of FIG. 5, the output signal can have a signal magnitude or value of −1.2V, such as relative to ground. In an example, the current sources 502 and 504 can be separately adjusted to trim the output signal Vref_neg to make the output signal substantially temperature invariant. In an example, the output signal Vref_neg can be used as a reference for a circuit with a bipolar supply, such as a bipolar analog-to-digital converter circuit. In another example the output signal Vref_neg can be amplified to produce any arbitrary negative voltage for various other uses or purposes.

Figure 6A:
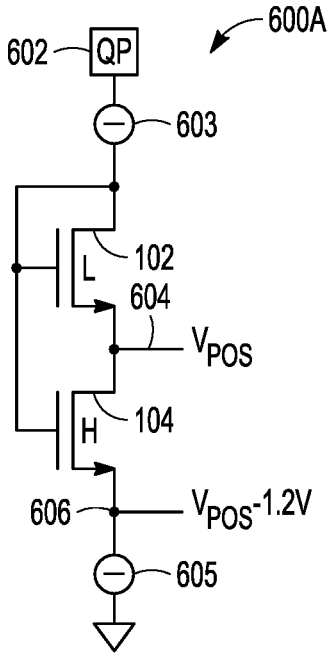
FIG. 6A illustrates generally a first example of a first step-down reference signal generator circuit.

FIG. 6A illustrates generally a first example of a first step-down reference signal generator circuit 600A. The first step-down reference signal generator circuit 600A can be configured to generate a reference output signal at a stepped-down output signal node 606. The output signal can be provided with respect to a positive supply signal Vpos at a positive supply signal input node 604.

The first step-down reference signal generator circuit 600A can include the standard nMOS device 102 and the flipped-gate nMOS device 104 coupled in series. The devices can have their respective gate terminals coupled together and coupled to a drain terminal of the standard nMOS device 102. That is, the standard nMOS device 102 can be diode-coupled and the gate terminal of the standard nMOS device 102 can be coupled to the flipped-gate nMOS device 104. The positive supply signal input node 604 can be coupled to the source terminal of the standard nMOS device 102 and to the drain terminal of the flipped-gate nMOS device 104. A charge pump circuit 602 can be coupled to a current source 603 which in turn can be coupled to the drain node of the standard nMOS device 102. In operation, the charge pump circuit 602 can provide a slightly greater magnitude voltage signal than is provided by Vpos at the positive supply signal input node 604.

The example of the first step-down reference signal generator circuit 600A of FIG. 6A is configured to consume a minimal amount of operating power, for example on the order of about 200 nA, and noise introduced by the charge pump circuit 602 can be minimized. The first step-down reference signal generator circuit 600A can thus provide a stepped-down reference signal at the stepped-down output signal node 606 having a magnitude that is about 1.2V below the positive supply signal Vpos. A current source 605 can be coupled between the output signal node 606 and the reference node or ground to provide a current flow path. The current sources 603 and 605 can be separately adjusted to trim the output signal such that it can be substantially temperature invariant.

Figure 6B:
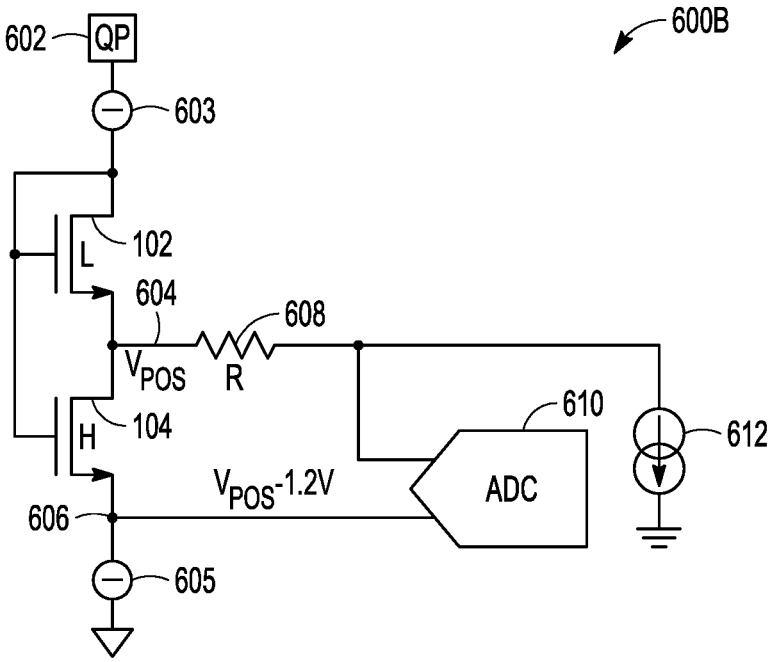
FIG. 6B illustrates generally an example of a step-down monitor circuit that can include or use the step-down reference signal generator circuit from FIG. 6A

In an example, the step-down reference signal generator circuit 600A can be used to provide conversion of a sensor signal, such as from a high voltage or high current signal to a digital output signal that can be used for feedback control or other purposes. FIG. 6B for example illustrates generally an example of a step-down monitor circuit 600B that can include or use the step-down reference signal generator circuit 600A from FIG. 6A. In the example of FIG. 6B, Vpos can include a high voltage supply rail, such as having a voltage of 500 V or more, such as can be found in a battery stack for vehicles or other high voltage applications. A current bias signal, such as can be provided by the current source 605, can be used to float circuitry containing the standard nMOS device 102 and the flipped-gate nMOS device 104 and an ADC 610 such that Vpos is dropped primarily across the current source.

In the example of FIG. 6B, a first side of a sense resistor 608 is coupled to the supply rail Vpos at the positive supply signal input node 604. An opposite second side of the sense resistor 608 can be coupled to the ADC 610 and a further bias source 612. The example of FIG. 6B enables direct conversion of a current sense signal measured by the ADC 610 using the sense resistor 608. For example, the ADC 610 can provide information about a magnitude relationship between signals received at its input terminals. For example, the ADC 610 can provide information about a difference between a magnitude of a signal received from the sense resistor 608 and a magnitude of a reference signal at the stepped-down output signal node 606.

Figure 7:
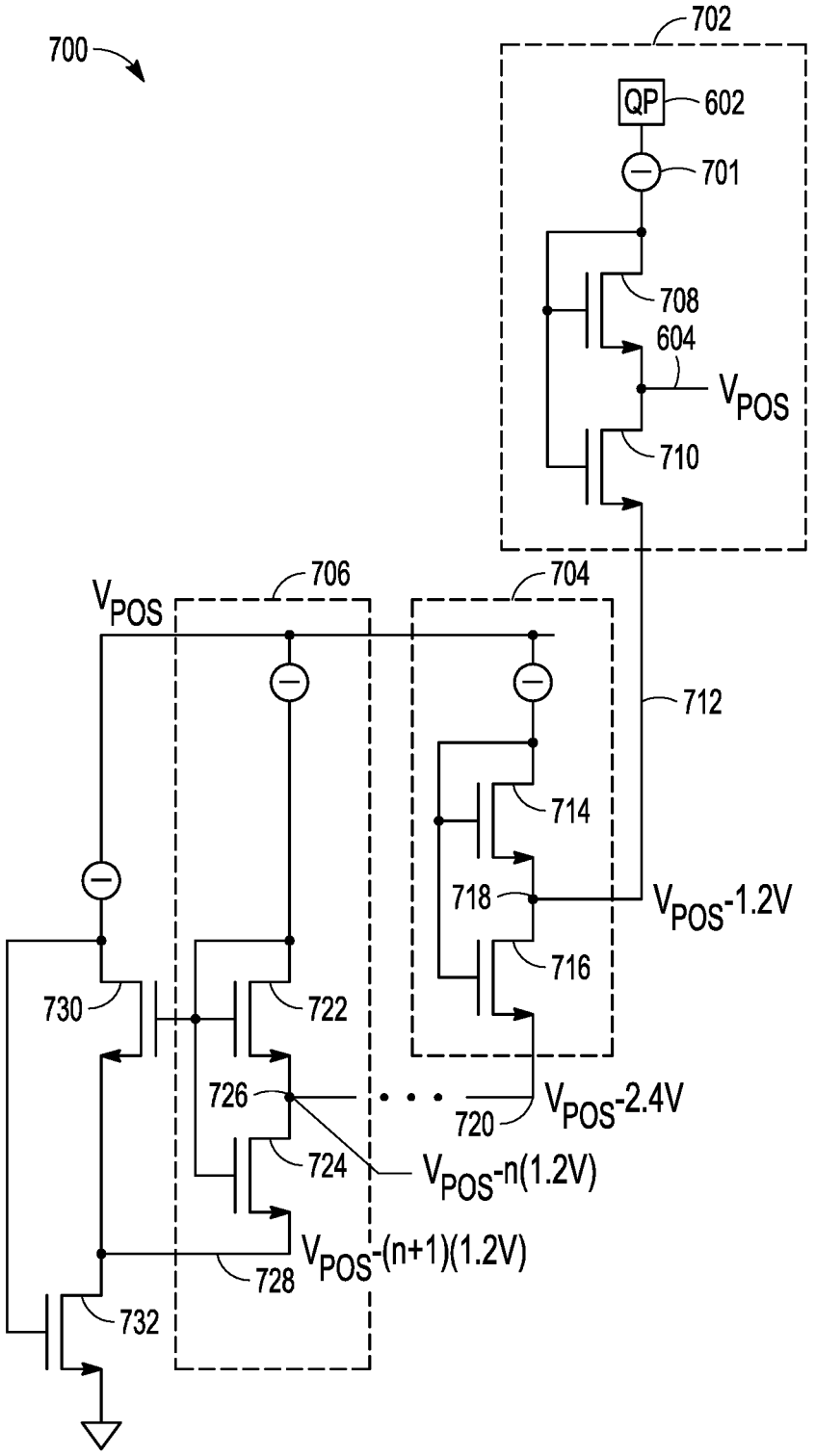
FIG. 7 illustrates generally an example of a second step-down reference signal generator circuit.

FIG. 7 illustrates generally an example of a second step-down reference signal generator circuit 700. The second step-down reference signal generator circuit 700 can include, for example, multiple instances of the first step-down reference signal generator circuit 600A that can be coupled together to provide various different voltage reference signals having respective different magnitude characteristics.

The example of the second step-down reference signal generator circuit 700 includes a first step-down stage 702, a second step-down stage 704, and an nth step-down stage 706. The second step-down reference signal generator circuit 700 further includes various output devices including an output-stage flipped-gate nMOS device 730 and an output-stage standard nMOS device 732. A source terminal of the output-stage standard nMOS device 732 can be coupled to a circuit ground or to a different reference signal source.

The first step-down stage 702 can include an instance of the first step-down reference signal generator circuit 600A, for example, including the charge pump circuit 602 coupled to a first stage standard nMOS device 708 and a first stage flipped-gate nMOS device 710 via a current source 701. The first step-down stage 702 can include the positive supply signal input node 604 coupled to the drain terminal of the first stage flipped-gate nMOS device 710. In an example, the first step-down stage 702 can include a first stage output node 712, such as can be configured to provide a reference signal having a magnitude that is about 1.2V below the positive supply signal Vpos.

In an example, instead of or additionally to using the reference signal at the first stage output node 712, the first stage output node 712 can be coupled to a second stage signal input node 718 of the second step-down stage 704. The second step-down stage 704 can include a second stage standard nMOS device 714 and a second stage flipped-gate nMOS device 716, such as can be serially coupled. For example, the second stage standard nMOS device 714 can be a diode-coupled device with its drain terminal coupled to a current source, and its source terminal coupled to a drain terminal of the second stage flipped-gate nMOS device 716. Gate terminals of the second stage standard nMOS device 714 and second stage flipped-gate nMOS device 716 can be coupled together. In an example, the second step-down stage 704 includes a second stage output node 720 that can provide a further stepped-down output signal having a magnitude that is about 2.4V below the positive supply signal Vpos.

In an example, one or more additional stages can be coupled together to provide a further stepped-down output signal. For example, the second step-down reference signal generator circuit 700 can include the nth step-down stage 706. The reference signal at the second stage output node 720 can be provided to an nth stage signal input node 726 of the nth step-down stage 706. The nth step-down stage 706 can include an nth stage standard nMOS device 722 and an nth stage flipped-gate nMOS device 724, such as can be serially coupled. For example, the nth stage standard nMOS device 722 can be a diode-coupled device with its drain terminal coupled to a current source, and its source terminal coupled to a drain terminal of the nth stage flipped-gate nMOS device 724. Gate terminals of the nth stage standard nMOS device 722 and nth stage flipped-gate nMOS device 724 can be coupled together. In an example, the nth step-down stage 706 includes an nth stage output node 728 that can provide a further stepped-down output signal having a magnitude that is less than the positive supply signal Vpos by an amount that is a function of the number of stages used, for example, $V_{ref}=V_{pos}-(n+1)(1.2)$, where n indicates the number of stages.

In an example, the step-down reference signal generator circuit 700 can be used to generate a reference for a linear regulator that can provide a voltage that is (n+1)(1.2) V below Vpos for floated ground applications. In such an example, the output voltage can be buffered to provide a ground return for other high side circuits. In the absence of high sheet-resistance resistors, which can generally add additional cost, significant power and die area savings can thus be realized.

Figure 8:
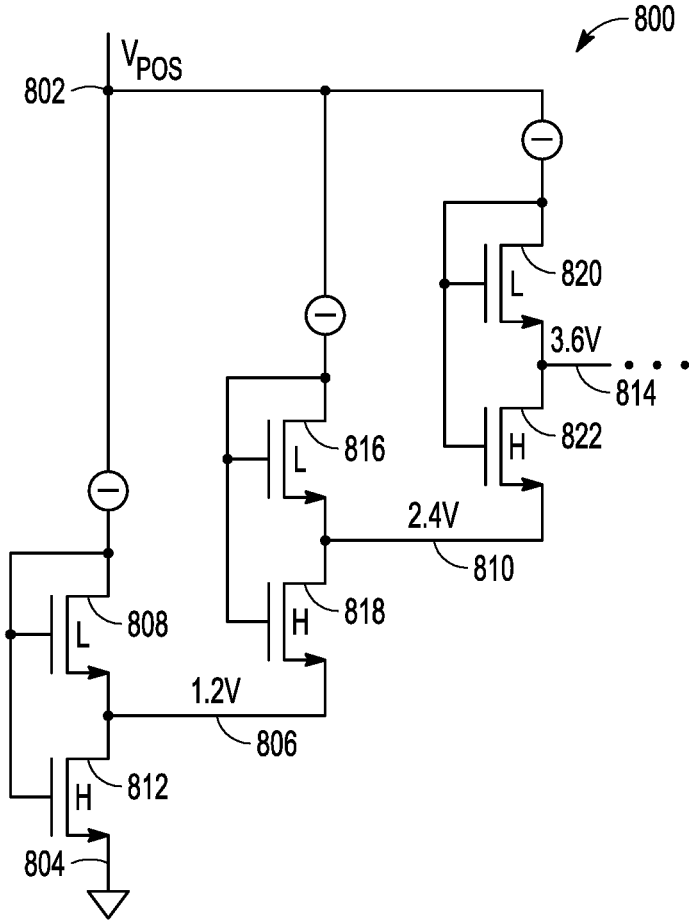
FIG. 8 illustrates generally an example of a first reference signal multiplier circuit.

FIG. 8 illustrates generally an example of a first reference signal multiplier circuit 800. The first reference signal multiplier circuit 800 can be configured to generate multiple reference output signals at respective different reference output signal magnitudes. The reference output signals can have respective signal magnitudes that can be different multiples of a base reference magnitude.

In an example, the first reference signal multiplier circuit 800 can include a supply rail 802 coupled to a first device pair that includes a first stage standard nMOS device 808 and a first stage flipped-gate nMOS device 812. The devices can have their respective gate terminals coupled together and coupled to a drain terminal of the first stage standard nMOS device 808 such that the first stage standard nMOS device 808 is diode-coupled. The supply rail 802 can be coupled via a current source to the drain and gate terminals of the first stage standard nMOS device 808. In the example of FIG. 8, the first device pair can have a first reference signal output node 806 at a junction between the source terminal of the first stage standard nMOS device 808 and the drain terminal of the first stage flipped-gate nMOS device 812. The first reference signal output node 806 can be configured to provide a first reference signal having a reference signal magnitude that is, for example, 1.2V above ground or above a voltage magnitude of a reference signal at the reference node 804.

In an example, the first reference signal multiplier circuit 800 can include a second device pair that includes a second stage standard nMOS device 816 that is serially-coupled to a second stage flipped-gate nMOS device 818. Similarly to the first device pair, the devices in the second device pair can include the second stage standard nMOS device 816 in a diode-coupled configuration with its drain terminal coupled to the supply rail 802 via a current source. A gate terminal of the second stage standard nMOS device 816 can be coupled to a gate terminal of the second stage flipped-gate nMOS device 818, and a source terminal of the second stage standard nMOS device 816 can be coupled to a drain terminal of the second stage flipped-gate nMOS device 818.

In the example, the source terminal of the second stage flipped-gate nMOS device 818 can be coupled to the first reference signal output node 806, such as instead of being coupled to ground or to the reference node 804. In the example of FIG. 8, the second device pair can have a second reference signal output node 810 at a junction between the source terminal of the second stage standard nMOS device 816 and the drain terminal of the second stage flipped-gate nMOS device 818. The second reference signal output node 810 can be configured to provide a second reference signal having a reference signal magnitude that is a multiple of the reference signal at the first reference signal output node 806. That is, in the example of FIG. 8, a reference signal at the second reference signal output node 810 can be about 2.4V, or two times the magnitude of the reference signal at the first reference signal output node 806.

In an example, the first reference signal multiplier circuit 800 can be configured to provide a different multiple of the reference signal at a third reference signal output node 814, such as using a second device pair. For example, the first reference signal multiplier circuit 800 can include a third device pair that includes a third stage standard nMOS device 820 that is serially-coupled to a third stage flipped-gate nMOS device 822. Similarly to the first and second device pairs, the devices in the third device pair can include the third stage standard nMOS device 820 in a diode-coupled configuration with its drain terminal coupled to the supply rail 802 via a current source. A gate terminal of the third stage standard nMOS device 820 can be coupled to a gate terminal of the third stage flipped-gate nMOS device 822, and a source terminal of the third stage standard nMOS device 820 can be coupled to a drain terminal of the third stage flipped-gate nMOS device 822. In the example, the source terminal of the third stage flipped-gate nMOS device 822 can be coupled to the second reference signal output node 810, such as instead of being coupled to ground or to the reference node 804. In the example of FIG. 8, the third device pair can have the third reference signal output node 814 at a junction between the source terminal of the third stage standard nMOS device 820 and the drain terminal of the third stage flipped-gate nMOS device 822. The third reference signal output node 814 can be configured to provide a third reference signal having a reference signal magnitude that is a multiple of the reference signal at the first reference signal output node 806. That is, in the example of FIG. 8, a reference signal at the third reference signal output node 814 can be about 3.6V, or three times the magnitude of the reference signal at the first reference signal output node 806. Additional stages of device pairs can similarly be included to provide further stepped multiples of the reference signal. The number of stages can be limited, for example, by a magnitude of the supply signal at the supply rail 802. In an example, the multiplied reference output can be used to produce a supply rail such as in a linear regulator or as a reference for a data converter or for other purposes. Since the multiplication does not involve high sheet-resistance resistors, there can be less power consumed, lower cost and lesser area penalty relative to other designs.

Figure 9:
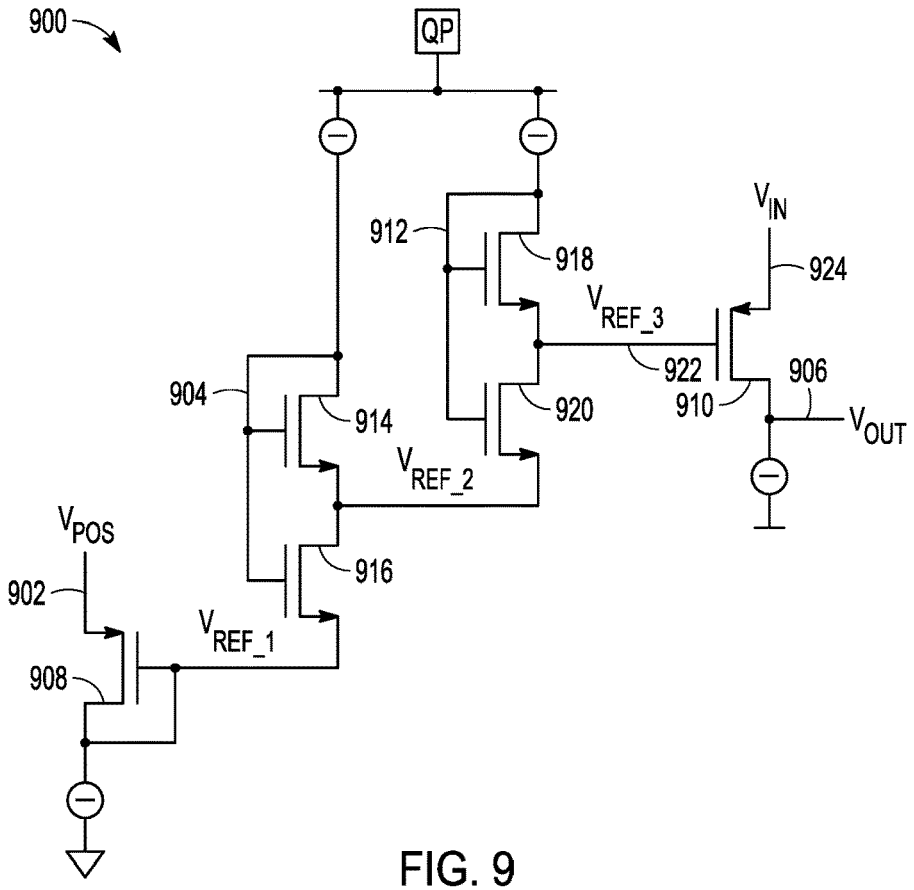
FIG. 9 illustrates generally an example of a comparator circuit.

FIG. 9 illustrates generally an example of a comparator circuit 900. The example of the comparator circuit 900 can include or use one or more standard and flipped-gate nMOS device pairs to generate a reference signal against which a test signal Vin can be compared.

For example, the comparator circuit 900 can include a first supply rail 902 that can provide a supply signal Vpos to a diode-connected PMOS input device 908. The PMOS input device 908 can provide, at its gate terminal, a first reference signal Vref_1 to a first device pair 904.

The first device pair 904 can include a first stage standard nMOS device 914 and a first stage flipped-gate nMOS device 916. The first stage standard nMOS device 914 and first stage flipped-gate nMOS device 916 can be serially coupled, and the first stage standard nMOS device 914 can be diode-coupled. A gate terminal of the first stage flipped-gate nMOS device 916 can be coupled to a gate terminal of the first stage standard nMOS device 914. In an example, a second reference signal Vref_2 can be provided at a drain terminal of the first stage flipped-gate nMOS device 916.

In an example, the comparator circuit 900 can include a second device pair 912 coupled to the first device pair 904. For example, the second device pair 912 can include a second stage standard nMOS device 918 and a second stage flipped-gate nMOS device 920. The second stage standard nMOS device 918 and the second stage flipped-gate nMOS device 920 can be serially coupled, and the second stage standard nMOS device 918 can be diode-coupled. A gate terminal of the second stage standard nMOS device 918 can be coupled to a gate terminal of the second stage flipped-gate nMOS device 920. In an example, a third reference signal Vref_3 can be provided at a drain terminal of the second stage flipped-gate nMOS device 920.

In an example, the comparator circuit 900 includes a PMOS output device 910. The PMOS output device 910 can be configured to receive, at its source terminal, a comparator input signal 924, or Vin. A value of Vin can be compared to a threshold value. The threshold value can correspond to a value of the third reference signal Vref_3, and a comparison result can be provided or measured from the drain terminal of the PMOS output device 910. That is, the comparator circuit 900 can provide a signal Vout at a comparator output node 906 that is at a drain terminal of the PMOS output device 910. The signal Vout indicates a relationship between the comparator input signal 924 Vin and the third reference signal Vref_3 at the drain terminal of the second stage flipped-gate nMOS device 920.

In the example of FIG. 9, the threshold value or Vref_3 can be adjusted based on a number of stages used between the PMOS input device 908 and the PMOS output device 910. The example of FIG. 9 illustrates two stages, however, additional stages or as few as one stage can similarly be used to provide the threshold value against which the input signal Vin is compared. In an example, the circuit 900 can be used as a common gate amplifier to regulate Vin to a specified threshold voltage value, such as for example 2.4V above Vpos. By setting up the threshold serially using the common gate configuration, such as opposed to providing the threshold at the source of PMOS input device 908 or the PMOS output device 910, can help avoid a reduction in gain due to source degeneration.

Figure 10:
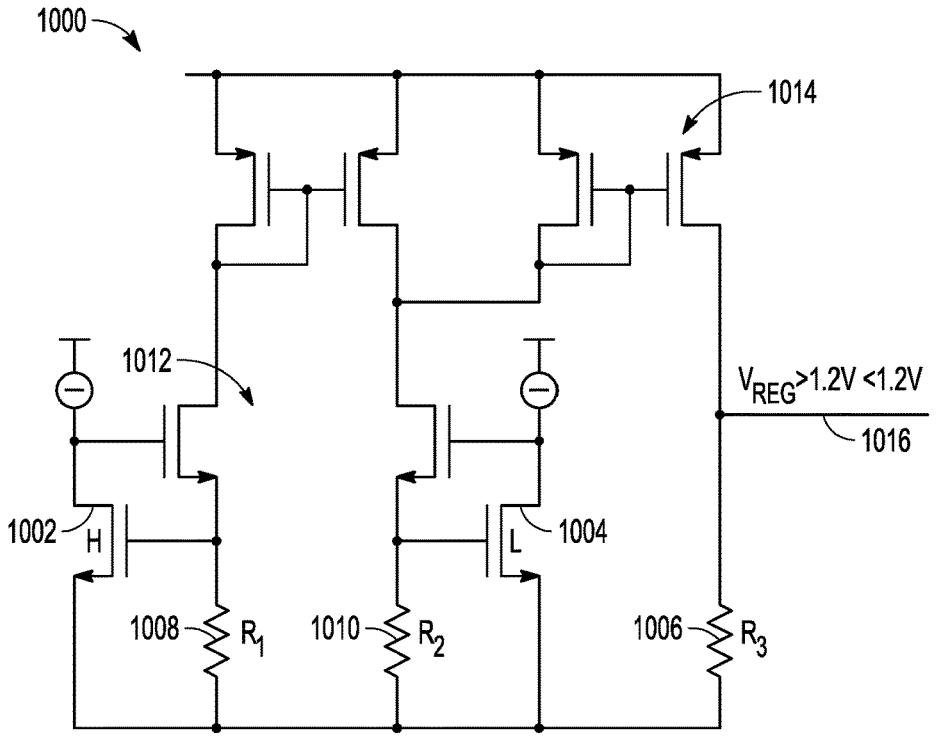
FIG. 10 illustrates generally an example of an adjustable reference signal generator circuit.

FIG. 10 illustrates generally an example of an adjustable reference signal generator circuit 1000. The adjustable reference signal generator circuit 1000 can be configured to provide a voltage reference output signal Vref with a user-specified magnitude. In an example, the adjustable reference signal generator circuit 1000 is configured to use a standard nMOS device and a flipped-gate nMOS device together to provide an intermediate reference voltage signal at a first signal magnitude, convert the intermediate reference voltage signal to a current, and then provide the voltage reference output signal Vref having a different second signal magnitude.

For example, the adjustable reference signal generator circuit 1000 can include a flipped-gate nMOS device 1002 coupled between a supply node and ground, and a standard nMOS device 1004 coupled between a supply node and ground. The gate and drain terminals of the flipped-gate nMOS device 1002 can be coupled through a gate-source junction of a first transistor in a nMOS pair of transistors 1012, and the gate and drain terminals of the standard nMOS device 1004 can be coupled through a gate-source junction of a second transistor in the nMOS pair of transistors 1012. The gate terminals of the flipped-gate nMOS device 1002 and standard nMOS device 1004 can be coupled to ground via a first voltage-to-current conversion resistor 1008 and a second voltage-to-current conversion resistor 1010, respectively.

In an example, voltage signals at the gate terminals of the flipped-gate nMOS device 1002 and standard nMOS device 1004 can be converted to current signals using the first voltage-to-current conversion resistor 1008 and second voltage-to-current conversion resistor 1010, and the resulting current signals can be mirrored through a current mirroring network 1014 to a reference voltage output node 1016. The reference voltage output node 1016 can be coupled to ground via an output resistor 1006. A value of the output resistor 1006 can be selected or adjusted to provide the voltage reference output signal Vref at a specified voltage magnitude. For example, a relatively higher value or resistance of the output resistor 1006 can be used to provide a relatively greater magnitude output signal Vref, or a lower value or lesser resistance of the output resistor 1006 can be used to provide a relatively lesser magnitude output signal Vref. In an example, a value of the output resistor 1006 can be specified at a point of manufacture or can be provided by a user.

Figure 11:
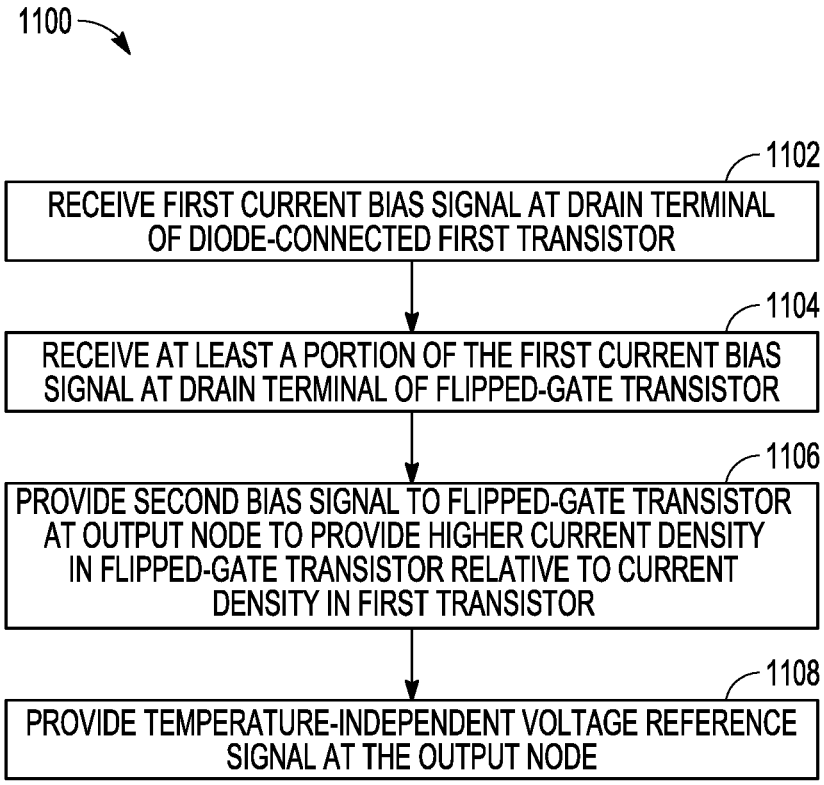
FIG. 11 illustrates generally an example of a first method that can include generating a voltage reference signal.

FIG. 11 illustrates generally an example of a first method 1100 that can include generating a voltage reference signal. In an example, the first method 1100 includes using a pair of MOSFET devices, including a standard device and a flipped-gate nMOS device arranged in series to generate the voltage reference signal.

In block 1102, the first method 1100 can include receiving a first current bias signal at a drain terminal of a diode-connected first transistor. In an example, the first transistor can include a standard nMOS device, such as the standard nMOS device 102 from the example of FIG. 1. In an example, the first transistor can be coupled between a current source and the output node that is configured to provide the voltage reference signal. That is, the first transistor can include a drain terminal coupled to a current source and a source terminal coupled to the output node.

In block 1104, the first method 1100 can include receiving at least a portion of the first current bias signal at a drain terminal of a flipped-gate transistor, such as the flipped-gate nMOS device 104 from the example of FIG. 1. In an example, the flipped-gate transistor can be coupled between the output node and a reference node (e.g., ground). That is, the flipped-gate transistor can include a drain terminal coupled to the output node and a source terminal coupled to ground.

In block 1106, the first method 1100 can include providing a second bias signal to the flipped-gate transistor at the output node to provide a higher current density in the flipped-gate transistor relative to a current density in the first transistor. In an example, providing the second bias signal in block 1106 can include selecting a number of discrete transistor devices to use to provide the second bias signal from the supply node to the output node.

In block 1108, the first method 1100 can include providing a substantially temperature-independent voltage reference signal at the output node. That is, block 1108 can include providing a voltage signal that is substantially stable over changes in temperature of a substrate that comprises at least the first transistor and the flipped-gate transistor. The voltage reference signal can be used as a stable reference or source for various circuitry, such as in signal converter circuits, switch control circuits, hot-swap control circuits, signal monitoring circuits, analog-to-digital converter circuits, power converter circuits, or other circuits where highly precise monitoring or measurement is required or used.

In an example, the first method 1100 can further include stepping up or stepping down a magnitude of the reference signal to provide a differently-valued reference signal. In an example, circuitry to provide the stepped-up or stepped-down signals can include or use one or more other instances of a serially-coupled transistor and flipped-gate transistor pair.

In an example, the first method 1100 can include receiving, at a buffer or gain circuit, a voltage signal from the output node, and stepping up or stepping down a magnitude of the received voltage signal using the gain circuit.

In an example, and as discussed elsewhere herein, a problem to be solved includes providing a reference voltage or reference current signal that is substantially stable, temperature-independent, and useful over expected process-related manufacturing variations. Various aspects of the present disclosure can help provide a solution to these and other problems associated with reference-providing circuits.

In an example, Aspect 1 can include or use subject matter (such as an apparatus, a system, a device, a method, a means for performing acts, or a device readable medium including instructions that, when performed by the device, can cause the device to perform acts, or an article of manufacture), such as can include or use a reference signal generator configured to provide a temperature-compensated voltage reference signal at an output node. In Aspect 1, the reference signal generator can comprise a first transistor coupled between a supply node (e.g., comprising a current source) and the output node, a flipped-gate transistor coupled between the output node and a reference node, and a bias current source configured to provide a bias current to the flipped-gate transistor at the output node to adjust a current density in the flipped-gate transistor relative to a current density in the first transistor.

Aspect 2 can include or use, or can optionally be combined with the subject matter of Aspect 1, to optionally include the first transistor having an N+ type gate, and to include the flipped-gate transistor having an N+ type gate that is counter-doped with a P+ type material.

Aspect 3 can include or use, or can optionally be combined with the subject matter of one or any combination of Aspects 1 or 2 to optionally include the supply node electrically coupled to a gate terminal of the first transistor and to a gate terminal of the flipped-gate transistor.

Aspect 4 can include or use, or can optionally be combined with the subject matter of one or any combination of Aspects 1 through 3 to optionally include or use a ratio of an effective gate width of the first transistor to an effective gate width of the flipped-gate transistor that is at least 10:1.

Aspect 5 can include or use, or can optionally be combined with the subject matter of one or any combination of Aspects 1 through 4 to optionally include, as the bias current source, multiple transistor devices coupled in parallel. In Aspect 5, fewer than all of the multiple transistor devices can be selected to provide an adjustable bias current.

Aspect 6 can include or use, or can optionally be combined with the subject matter of one or any combination of Aspects 1 through 5 to optionally include or use a first current source configured to provide a reference current to a drain node of the first transistor, wherein a magnitude of the reference current is greater than a magnitude of the bias current from the bias current source.

Aspect 7 can include or use, or can optionally be combined with the subject matter of one or any combination of Aspects 1 through 6 to optionally include the first current source and the bias current source comprising respective transistors coupled to a common supply node.

Aspect 8 can include or use, or can optionally be combined with the subject matter of one or any combination of Aspects 1 through 7 to optionally include or use an output buffer circuit coupled to the output node, and the output buffer circuit can be configured to step up or step down a magnitude of a voltage signal at the output node.

Aspect 9 can include or use, or can optionally be combined with the subject matter of one or any combination of Aspects 1 through 8 to optionally include or use a second transistor and a second flipped-gate transistor coupled in series between the current supply node and the output node, and a stepped-up reference node coupled to a source of the second transistor and coupled to a drain of the second flipped-gate transistor. In Aspect 9, a drain node of the second transistor, a gate node of the second transistor, and a gate node of the second flipped-gate transistor can be electrically coupled. In Aspect 9, the stepped-up reference node can provide a reference signal output having a signal magnitude that is greater than the voltage reference signal at the output node.

Aspect 10 can include or use, or can optionally be combined with the subject matter of one or any combination of Aspects 1 through 8 to optionally include the output node coupled to a supply rail, and the reference node at a drain node of the flipped-gate transistor can be configured to provide a stepped-down reference signal relative to a signal on the supply rail.

Aspect 11 can include or use subject matter (such as an apparatus, a system, a device, a method, a means for performing acts, or a device readable medium including instructions that, when performed by the device, can cause the device to perform acts, or an article of manufacture), such as can include or use a method for providing a temperature-compensated voltage reference signal at an output node using a reference signal generator. In an example, Aspect 11 can include receiving a first current bias signal at a drain terminal of a diode-connected first transistor, the first transistor coupled between a supply node and the output node, and receiving at least a portion of the first current bias signal at a drain terminal of a flipped-gate transistor coupled between the output node and a reference node, and providing a second bias signal to the flipped-gate transistor at the output node to provide a higher current density in the flipped-gate transistor relative to a current density in the first transistor.

Aspect 12 can include or use, or can optionally be combined with the subject matter of Aspect 11, to optionally include providing the second bias signal, including selecting a number of discrete transistor devices to use to provide the second bias signal from the supply node to the output node.

Aspect 13 can include or use, or can optionally be combined with the subject matter of Aspect 11 or Aspect 12, to optionally include stepping up or stepping down a magnitude of the reference signal using one or more additional instances of a serially-coupled transistor and flipped-gate transistor pair.

Aspect 14 can include or use, or can optionally be combined with the subject matter of one or any combination of Aspects 11 through 13, to optionally include receiving, at a gain circuit, a voltage signal from the output node, and stepping up or stepping down a magnitude of the received voltage signal using the gain circuit.

Aspect 15 can include or use, or can optionally be combined with the subject matter of one or any combination of Aspects 11 through 14, to optionally include electrically coupling the supply node, the drain terminal of the diode-connected first transistor, and a gate terminal of the flipped-gate transistor.

Aspect 16 can include or use, or can optionally be combined with the subject matter of one or any combination of Aspects 11 through 15, to optionally include receiving the first current bias signal, including using a second transistor coupled between the supply node and the drain terminal of the diode-connected first transistor. In an example, in Aspect 16, providing the second bias signal can include using a third transistor coupled between the supply node and the output node.

Aspect 17 can include or use subject matter (such as an apparatus, a system, a device, a method, a means for performing acts, or a device readable medium including instructions that, when performed by the device, can cause the device to perform acts, or an article of manufacture), such as can include or use a reference signal generator configured to provide a temperature-compensated voltage reference signal at an output node. In Aspect 17, the reference signal generator can include a diode-connected first FET device coupled between a supply node and the output node, a flipped-gate transistor coupled between the output node and a reference node, and the flipped-gate transistor can include a gate terminal coupled to a drain terminal of the first FET device, and Aspect 17 can further include a bias current source configured to provide a bias current to the output node to adjust a current density in the flipped-gate transistor relative to a current density in the first transistor.

Aspect 18 can include or use, or can optionally be combined with the subject matter of Aspect 17, to optionally include the first FET device including an N+ type gate, and the flipped-gate transistor can include an N+ type gate that is counter-doped with a P+ type material.

Aspect 19 can include or use, or can optionally be combined with the subject matter of Aspect 17 or Aspect 18, to optionally include the ratio of an effective gate width of the first FET device to an effective gate width of the flipped-gate transistor is at least 10:1.

Aspect 20 can include or use, or can optionally be combined with the subject matter of one or any combination of Aspects 17 through 19, to optionally include the bias current source comprising multiple transistor devices coupled in parallel, and fewer than all of the multiple transistor devices are selected to provide an adjustable bias current to the output node.

This detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. The present inventors contemplate examples using any combination or permutation of those elements shown or described (or one or more aspects thereof), either with respect to a particular example (or one or more aspects thereof), or with respect to other examples one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein."

In the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A reference signal generator configured to provide a voltage reference signal at an output node, the reference signal generator comprising:

a first transistor coupled between a first node and the output node;

a flipped-gate transistor coupled between the output node and a reference node; and a bias current source configured to provide an adjustable bias current to the flipped-gate transistor, wherein the bias current source comprises multiple transistor devices coupled in parallel, and wherein selected transistor devices of the multiple transistor devices are selected to provide the adjustable bias current to the flipped-gate transistor.

2. The reference signal generator of claim 1, wherein the bias current source is coupled to the output node, and the bias current source is configured to provide the bias current at the output node to adjust a current density in the flipped-gate transistor relative to a current density in the first transistor.

3. The reference signal generator of claim 1, wherein the first transistor comprises an N+ type gate, and wherein the flipped-gate transistor comprises an N+ type gate that is counter-doped with a P+ type material.

4. The reference signal generator of claim 1, wherein the first node is electrically coupled to a gate terminal of the first transistor and to a gate terminal of the flipped-gate transistor.

5. The reference signal generator of claim 1, wherein a ratio of an effective gate width of the first transistor to an effective gate width of the flipped-gate transistor is at least 10:1.

6. The reference signal generator of claim 1, further comprising an output buffer circuit coupled to the output node.

7. The reference signal generator of claim 6, wherein the output buffer circuit is configured to step up or step down a magnitude of the voltage reference signal at the output node.

8. A reference signal generator configured to provide a voltage reference signal at an output node, the reference signal generator comprising:

a first transistor coupled between a first node and the output node;

a flipped-gate transistor coupled between the output node and a reference node;

a bias current source configured to provide an adjustable bias current to the flipped-gate transistor; and a first current source configured to provide a reference current to a drain node of the first transistor.

9. The reference signal generator of claim 8, wherein a magnitude of the reference current is greater than a magnitude of the bias current from the bias current source.

10. The reference signal generator of claim 8, wherein the first current source and the bias current source comprise respective transistors coupled to a common supply node.

11. A method for providing a voltage reference signal at an output node using a reference signal generator, the method comprising:

providing a first bias signal at a drain terminal of a diode-connected first transistor, the first transistor coupled between a supply node and the output node;

providing at least a portion of the first bias signal at a drain terminal of a flipped-gate transistor that is coupled between the output node and a reference node; and providing a second bias signal to the flipped-gate transistor at the output node.

12. The method of claim 11, wherein providing the second bias signal includes providing the second bias signal to provide a greater current density in the flipped-gate transistor relative to a current density in the first transistor.

13. The method of claim 11, further comprising stepping up or stepping down a magnitude of the voltage reference signal using one or more instances of a serially-coupled transistor and flipped-gate transistor.

14. The method of claim 11, further comprising receiving, at a gain circuit, a voltage signal from the output node, and stepping up or stepping down a magnitude of the received voltage signal using the gain circuit.

15. A reference signal generator configured to provide a voltage reference signal at an output node, the reference signal generator comprising:

a diode-connected first FET device coupled between a first node and the output node;

a flipped-gate transistor coupled between the output node and a reference node; and a bias current source coupled to the output node.

16. The reference signal generator of claim 15, wherein the flipped-gate transistor comprises a gate terminal coupled to a drain terminal of the first FET device.

17. The reference signal generator of claim 15, wherein the bias current source is configured to provide a bias current signal to the output node to thereby adjust a current density in the flipped-gate transistor relative to a current density in the first transistor.

18. The reference signal generator of claim 15, wherein the first FET device comprises an N+ type gate, and wherein the flipped-gate transistor comprises an N+ type gate that is counter-doped with a P+ type material.

19. The reference signal generator of claim 15, wherein a ratio of an effective gate width of the first FET device to an effective gate width of the flipped-gate transistor is at least 10:1.

* * * * *